US008976200B1

(12) United States Patent
Kona et al.

(10) Patent No.: US 8,976,200 B1
(45) Date of Patent: Mar. 10, 2015

(54) DISPLAY CONTROLLER FOR ROTATION OF IMAGE DATA

(75) Inventors: Anitha Kona, Austin, TX (US); Susan Lin, Austin, TX (US)

(73) Assignee: Marvell International Ltd. (BM)

( * ) Notice: Subject to any disclaimer, the term of this patent is extended or adjusted under 35 U.S.C. 154(b) by 993 days.

(21) Appl. No.: 12/722,654

(22) Filed: Mar. 12, 2010

Related U.S. Application Data

(60) Provisional application No. 61/161,334, filed on Mar. 18, 2009.

(51) Int. Cl.
*G09G 5/00* (2006.01)

(52) U.S. Cl.
USPC ..... 345/649; 345/656; 345/658

(58) Field of Classification Search
CPC . G06T 3/606; G06T 3/602; G06F 2200/1614; G06F 1/0307; G06F 2101/04; G09G 1/1626; G09G 5/363; G09G 5/393; G09G 2340/0492
USPC ..... 345/649, 55, 658, 531, 537, 570–572, 345/574, 656–659; 382/260, 296
See application file for complete search history.

(56) References Cited

U.S. PATENT DOCUMENTS 4,545,069 A * 10/1985 Kermisch ..... 345/657
5,091,721 A * 2/1992 Hamori ..... 345/656
6,104,416 A 8/2000 McGuinness
6,208,767 B1 * 3/2001 Chapin ..... 345/658
6,301,397 B1 * 10/2001 Jankowski et al. ..... 345/649
6,643,415 B1 * 11/2003 Fukai et al. ..... 345/659
7,924,296 B2 * 4/2011 Guha ..... 345/537
2003/0058354 A1 3/2003 Parulski et al.
2004/0218099 A1 11/2004 Washington
2004/0223058 A1 11/2004 Richter et al.
2006/0001905 A1 1/2006 Utsunomiya
2006/0104543 A1 * 5/2006 Schweng ..... 345/649
2007/0019005 A1 * 1/2007 van Baarsen et al. ..... 345/649
2007/0195113 A1 * 8/2007 Walton et al. ..... 345/649
2008/0029221 A1 2/2008 Dangami et al.
2008/0219588 A1 9/2008 Swann
2009/0096813 A1 * 4/2009 Nagaraj et al. ..... 345/649
2009/0189918 A1 * 7/2009 Ollmann ..... 345/658
2009/0202168 A1 * 8/2009 Watarai ..... 382/260
2009/0207101 A1 * 8/2009 Noguchi et al. ..... 345/55
2011/0110607 A1 * 5/2011 Walton et al. ..... 382/296

OTHER PUBLICATIONS

US Patent and Trademark Office (USPTO), Non-Final Office Action from U.S. Appl. No. 12/511,238, filed Jul. 29, 2009 having a Notification Date of Oct. 23, 2012 (8 pgs).

* cited by examiner

*Primary Examiner* — Chante Harrison

(57) ABSTRACT

In one embodiment, a display controller comprises control logic that rotates a frame image by two-dimensional blocks of pixels when the frame image is rotated from an original orientation.

20 Claims, 5 Drawing Sheets

DISPLAY CONTROLLER FOR ROTATION OF IMAGE DATA

CROSS REFERENCE TO RELATED APPLICATIONS

This application claims the benefit of U.S. provisional application Ser. No. 61/161,334, filed on Mar. 18, 2009 which is hereby incorporated by reference.

BACKGROUND

Image data is formed by pixels. A pixel is defined as a point that can be displayed on a display screen. Color values are assigned for pixels and are commonly stored in a memory as 1-bit monochrome, 4-bit palettized, 8-bit palettized, 16-bit highcolor, and 24-bit truecolor formats. To reconstruct an image on the display screen, a display controller obtains color values for pixels from the memory and causes the color values to be displayed on a display device. When the stored image is displayed without rotation, the display controller requests, for example, 32 byte transactions per request to retrieve pixels sequentially across rows from the memory. Each row/line of pixels is then sequentially displayed on the display screen in rows/lines (e.g. top row to bottom row). Since the retrieved data corresponds to the displayed data, there is no re-fetching of data (e.g. once the data is requested, it is used/displayed sequentially and not thrown away).

However when the stored image is displayed in a rotated form (e.g. 90 degree rotation), inefficient memory accesses are performed and some data that is retrieved gets discarded. For example, the display controller can only use and display one pixel from a horizontal line at a time since pixels are read from the memory in horizontal lines, but then are rotated to vertical lines (e.g. in 90 degree rotation). This leaves only one pixel to be displayed while the others are discarded. Depending on the image format, one pixel can be 4 bytes (RGB32/24), 3 bytes (RGB24p), 2 bytes (RGB16), or 1 byte (YCbCr). If the minimum transaction is 8 bytes, there is unused data that is discarded and that will need to be re-fetched again in subsequent memory accesses. This is especially inefficient for YCbCr image formats since the same data is fetched 8 times over the duration of one image frame. Hence, bandwidth usage is increased by 8 times. A more efficient way to process and display image data may be desirable.

SUMMARY

In one embodiment, a display controller comprises control logic that rotates a frame image by two-dimensional blocks of pixels when the frame image is rotated from an original orientation.

In another embodiment, a method comprises retrieving data representing an image from a memory as two-dimensional blocks of pixel data. The blocks of pixel data are rotated. The pixel data from the rotated blocks is then caused to be displayed on a display screen.

In another embodiment, a display controller comprises control logic that retrieves a frame image from a memory in two-dimensional blocks. Rotation logic rotates the frame image by rotating the two-dimensional blocks of the retrieved frame image in accordance with a rotation angle, where the display controller controls a display device to display the rotated frame image by displaying the rotated two-dimensional blocks sequentially on a display screen.

BRIEF DESCRIPTION OF THE DRAWINGS

The accompanying drawings, which are incorporated in and constitute a part of the specification, illustrate various examples of systems, methods, and other embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples, one element may be designed as multiple elements, or multiple elements may be designed as one element. In some examples, an element shown as an internal component of another element may be implemented as an external component and vice versa. Furthermore, elements may not be drawn to scale.

DETAILED DESCRIPTION

The disclosure describes a display controller for controlling imaging on a display device. In one example, the display device is a smart panel display that includes built-in internal frame buffers.

The following includes definitions of selected terms employed herein. The definitions include various examples and/or forms of components that fall within the scope of a term and that may be used for implementation. The examples are not intended to be limiting. Both singular and plural forms of terms may be used within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

Figure 1:
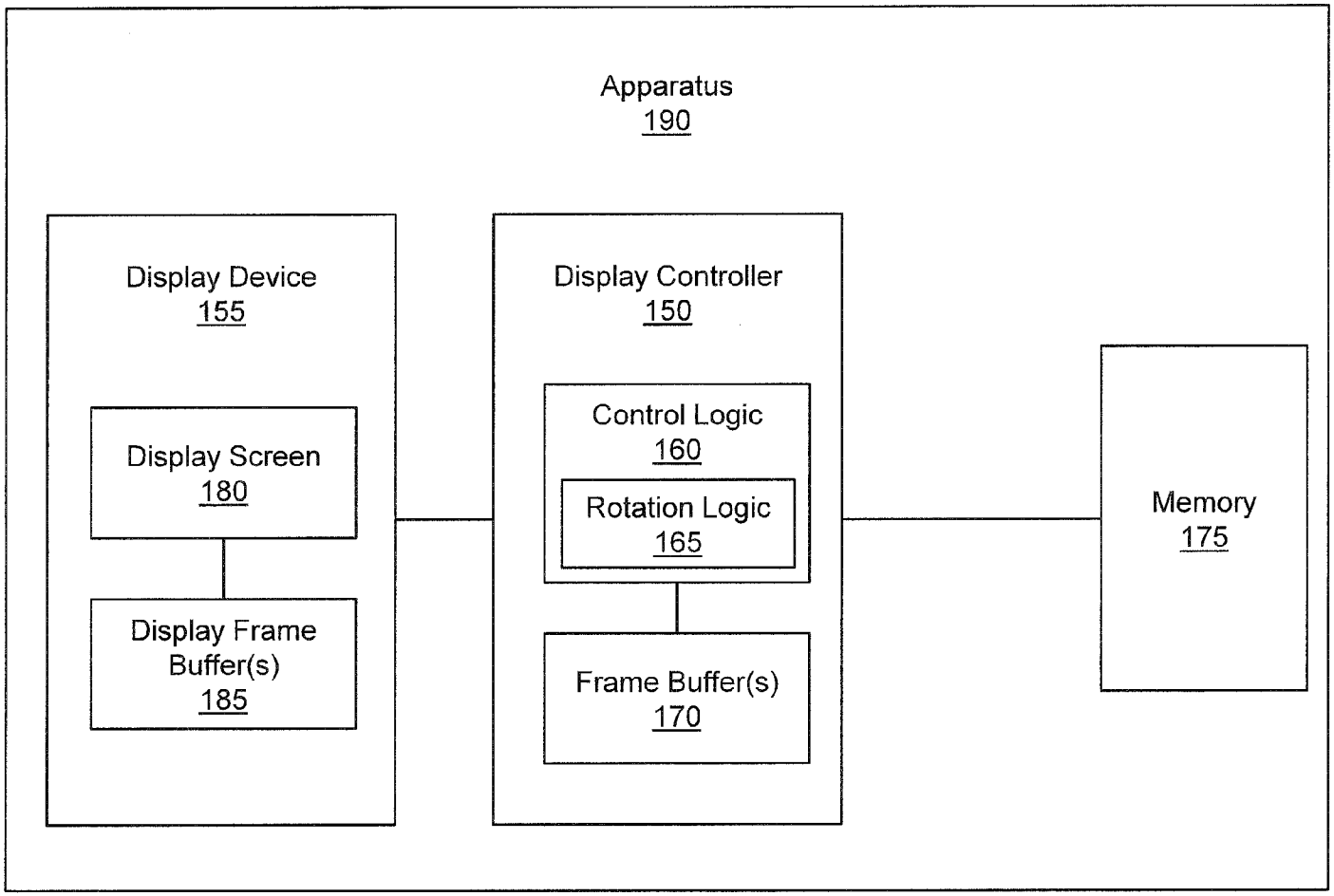
FIG. 1 illustrates an embodiment of a display controller and an example apparatus in which the display controller may operate.

FIG. 1 illustrates one embodiment of display controller 150 for interfacing with a display device 155 and controlling, at least in part, how image data is processed before the image data is displayed by the display device 155. The display controller 150 includes control logic 160, rotation logic 165, and a frame buffer(s) 170. The control logic 160 is configured to retrieve image data from a memory 175, store and process the image data using the frame buffer(s) 170, and control the display device 155. In one embodiment, the display device 155 includes a display screen 180 and may include one or more display frame buffers 185 (e.g. a smart panel display with internal buffers).

In one embodiment, the display controller 150 may be implemented as one or more integrated chips, logic (e.g. hardware and/or executable instructions stored in a storage medium), combinations of electrical components, and so on. The display controller 150 can be designed to be incorporated into an apparatus 190. The apparatus 190 can be, for example, a computer, a hand-held processing device, a communication device, and so on. The memory 175 can be internal (e.g. double-data-rate (DDR) memory) to the apparatus 190 or connected externally.

As an example of operation, suppose a request is received to rotate a displayed image by a selected angle (e.g. rotate by 90 degrees from an original orientation). Pixel data representing the image may be stored in the frame buffer 170 or memory 175. The pixel data will be referred to as a frame image. In one embodiment, the control logic 160 controls the display screen 180 to refresh the frame image in two-dimensional blocks of pixels when the frame image is rotated from the original orientation.

In one embodiment, the rotation logic 165 generates commands for retrieving or fetching image data from the memory 175. In response to a request to rotate the frame image, one or more commands are generated where the commands retrieve the data as two-dimensional blocks of pixel data (e.g. 16×16 pixels, 32×32 pixels, and so on). Thus a block of pixels spans across multiple lines of pixels in a frame. The rotation logic 165 may be programmed to define the block size. In one example, the block size can be defined based on an allowable request length according to the communication protocol used to access the memory 175. The data is then retrieved from the memory 175 in block transactions defined by the two-dimensional blocks of pixel data. One block transaction may include multiple requests to the memory 175 for portions of a block. By retrieving two-dimensional blocks of pixels, each pixel in the retrieved block is displayed on the display screen after being retrieved once.

In other words, by processing the pixel data in blocks as opposed to one-dimensional lines of pixels, pixels are not discarded during the rotation operation, only to be re-fetched again in a subsequent memory access for the next line of pixels. This is described in more detail with reference to FIGS. 2A and 2B. Processing the data in blocks, as performed by the display controller 150, decreases the amount of requests the display controller 150 has to make over a bus (e.g. an AXI bus or any system bus) to the memory 175 to retrieve and rotate all pixels from the frame image. As a result, system traffic performance may be improved.

Figure 2B:
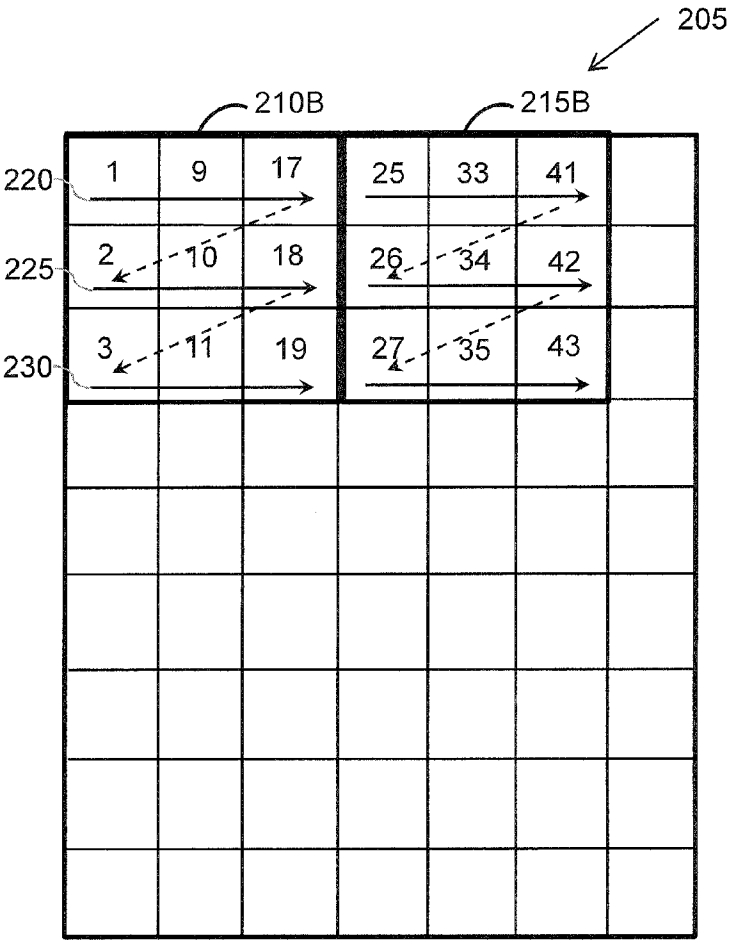
FIG. 2B illustrates an example of a display showing rotated pixels from FIG. 2A.
Figure 2A:
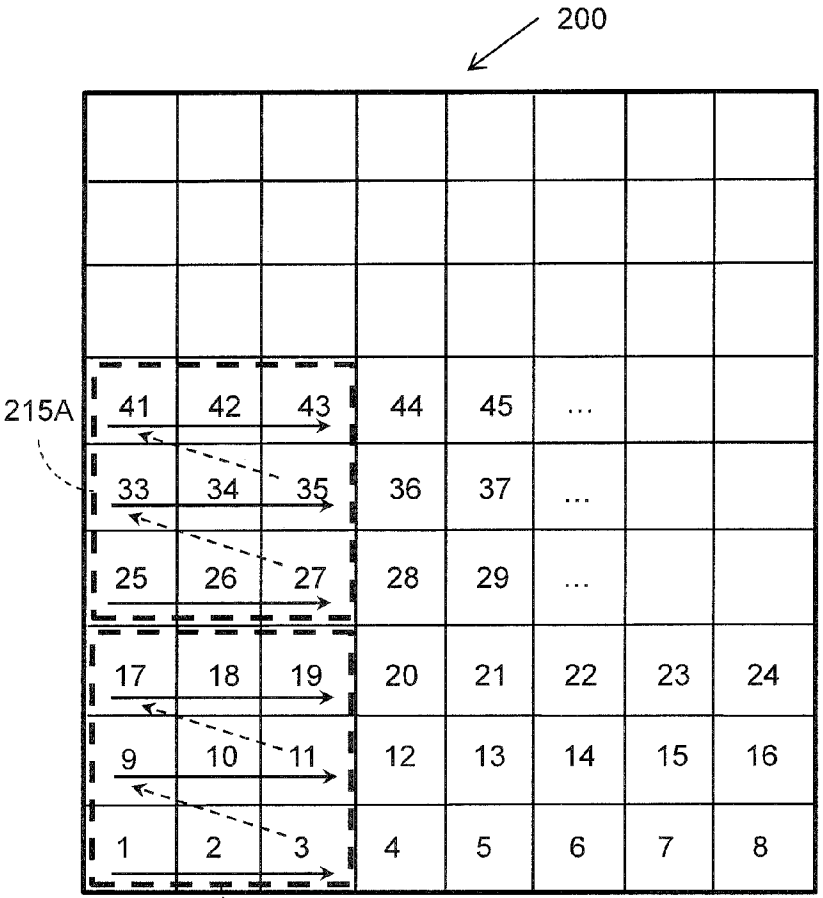
FIG. 2A illustrates an example of pixel memory.

With reference to FIGS. 2A and 2B, examples of operations of the control logic 160 are explained. FIG. 2A illustrates a portion of memory 200 that contains a frame of pixels. Suppose the frame is to be rotated 90 degrees clockwise. FIG. 2B illustrates a display map 205 of the pixels as displayed on the display screen 180 after the 90 degree rotation. Pixels are labeled 1, 2, 3 . . . . After rotation, pixel 1 in the lower left corner of FIG. 2A will be rotated to the upper left corner of the map 205 in FIG. 2B. To simplify the example, suppose a block size of 3×3 pixels is set. A command is generated that requests 3×3 blocks to be retrieved from the memory 200. Based on the rotation requested, a starting address can be designated at which the pixels are read from. In this example, the starting address identifies the location of pixel 1.

Starting at pixel 1 in FIG. 2A, three pixels are read from the memory 200 across the line (e.g. pixel 1, 2, and 3). The reading direction is illustrated by the solid arrow lines. The dashed arrow lines represent moving to the next line/memory location to continue reading. The next three pixels are read from the next line above (e.g. 9, 10, and 11), and then again for pixels 17, 18, and 19. This defines a 3×3 block 210A. The rotation logic 160 rotates the block of pixels. In one embodiment, the rotating is performed by retrieving (e.g. reading out) the pixels from the memory 175 in a rotated manner. The rotation logic 160 causes the block 210A to be displayed on the display screen 180 in accordance with the display map 205. For example, once the 3×3 block 210A is in a buffer (frame buffer 170) in the display controller 150, the pixels are read out vertically in the block 210A from bottom to top (e.g. 1, 9, 17, then 2, 10, 18, then 3, 11, 19) to perform the 90 degree rotation. The pixels are then displayed as rotated block 210B as the first three pixels in the first three horizontal lines in the display map 205 in FIG. 2B. The pixels are displayed in the order of 1, 9, 17; 2, 10, 18; and 3, 11, 19 as indicated by the arrow lines. Thus all of the pixels from the 3×3 block that are retrieved are used during the displaying/refreshing of the image.

The process then repeats for the next 3×3 block in the sequence based on the rotation, which in this case is block 215A vertically above block 210A in FIG. 2A. Block 215A is retrieved similarly as block 210A, rotated by reading out the pixels vertically, and displayed as rotated block 215B in FIG. 2B. The process continues until the complete image is rotated. In another embodiment, all blocks can be retrieved from the memory prior to performing the rotation operations and displaying the contents of the image.

In another embodiment, for 90 degree rotation to be obtained, data is fetched starting from the lower left corner of the map 200 (FIG. 2A). If an advanced extensible interface (AXI) protocol is used to communicate with the memory 175 (shown in FIG. 1), the AXI protocol requires each memory request to have a length associated with the request. The length determines the number of data that is returned for each request. Different systems may have different limitations on the length associated with each request. In general, to maximize bandwidth on the AXI protocol or other bus protocol, the control logic 160 may request the maximum length with each request based on the protocol. Thus the maximum amount of data can be returned with each request. For example, if 16×16 pixel blocks are used, each line has 16 pixels. If the bus protocol allows 8 pixels to be retrieved, then two requests are used to retrieve the 16 pixels from one line. Typically, multiple requests are made per line even though data from the first request is used and data from the second request may not immediately used, but rather is buffered. Retrieving all the block pixels from one memory bank may minimize latency by reducing the frequency with which the memory banks of the memory 175 are opened and closed (e.g. DDR memory banks). The block size requested from the memory 175 will vary depending on the length of each request, the buffer sizes available, and area considerations.

With reference again to FIG. 1, in another embodiment, the control logic 160 is configured to process both non-rotated image requests and rotated image requests. When a frame image is not rotated, the control logic 160 controls the display screen 180 to refresh the frame image in one-dimensional lines of pixels sequentially on the display screen 180. For example, the display controller 150 retrieves a full line of pixels and sends the line to the display screen 180. The full line is refreshed and then the next full line is retrieved and the process repeats. One full line represents one horizontal line of pixels across the display screen 180. In response to a request to rotate the frame image, the control logic 160 switches to a block refresh configuration and controls the rotation and refreshing of the frame image in two-dimensional blocks of pixels as discussed previously. Alternately, when refreshing a non-rotated image, the refresh can be block accessed and then pixels can be displayed in block form without rotation. Thus the control logic 160 displays pixels in blocks whether the image is rotated or not.

In another example, when data is retrieved from the memory 175, the data is in a non-rotated form. The rotation logic 165 generates requests to retrieve the data in a rotated form and then stored the data in the frame buffer 170 in a particular format corresponding to the rotation. Rotated data is generated by rotating the data to a selected orientation. One example operation of rotating the data is described with reference to FIGS. 2A and 2B. After a block is rotated (or frame is rotated) and ready for display, the control logic 160 transmits the rotated data to the display screen for display.

Figure 3:
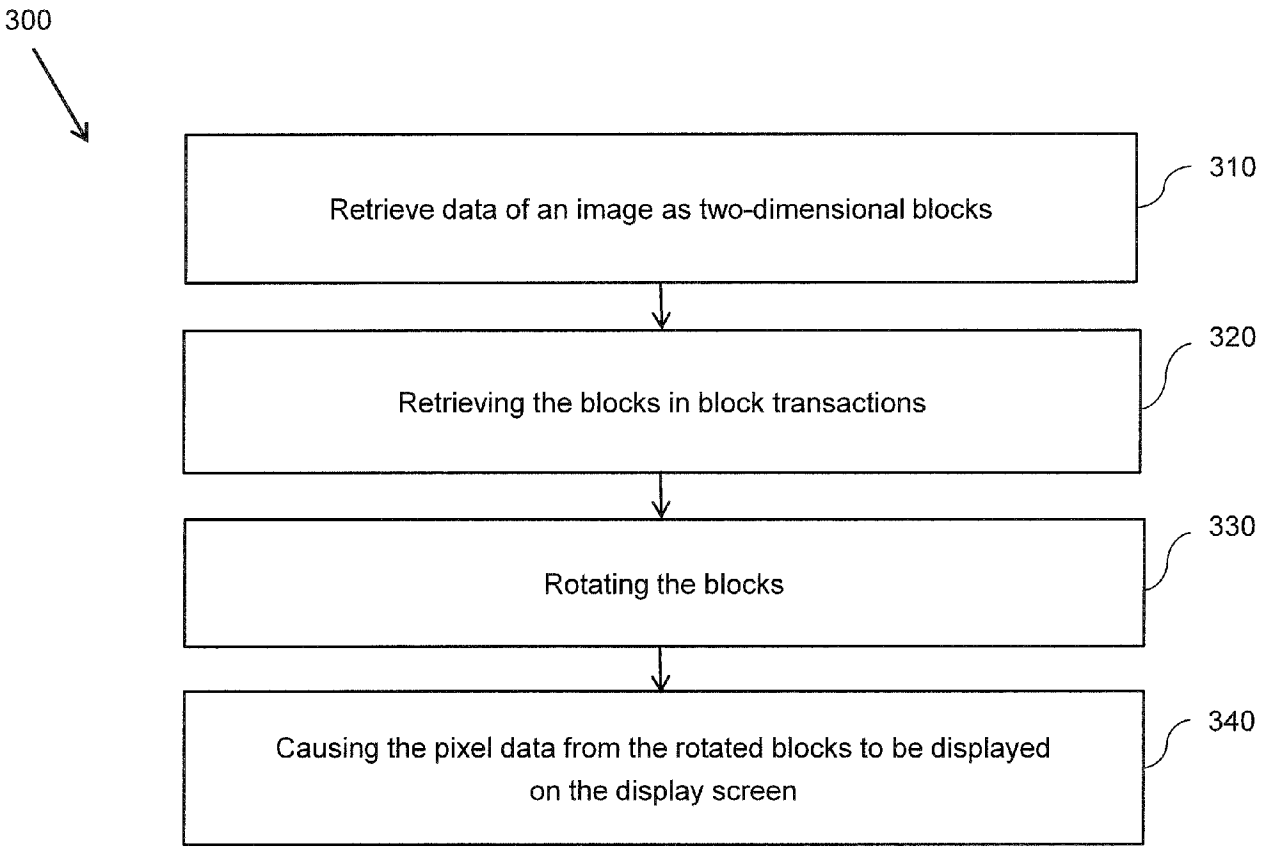
FIG. 3 illustrates one embodiment of a method associated with rotating an image.

With reference to FIG. 3, one embodiment of a method 300 is illustrated for processing a request to rotate image data. The method 300 generally reflects portions of the operations of the display controller 150 from FIG. 1 but in a different embodiment. At 310, the method initiates with a request to rotate an image on a display screen. In response to the request, one or more commands are generated to retrieve data representing the image from a memory. The commands are defined to retrieve the data as two-dimensional blocks of pixel data as explained previously. At 320, the blocks of pixel data are retrieved from the memory in block transactions using the commands. The blocks are retrieved in a manner according to the rotation. At 330, the retrieved blocks of pixel data are stored in a form represented the rotation. Examples of rotation operations were discussed with reference to FIGS. 2A and 2B. Of course, other types of rotation operations can be implemented that rotate data blocks based on a specified rotation angle. At 340, the pixel data from the rotated blocks are caused to be displayed on the display screen in a sequence defined by the rotated blocks. It will be appreciated that method 300 may be performed in other orders, may include additional actions, and/or may perform selected actions concurrently.

Figure 4:
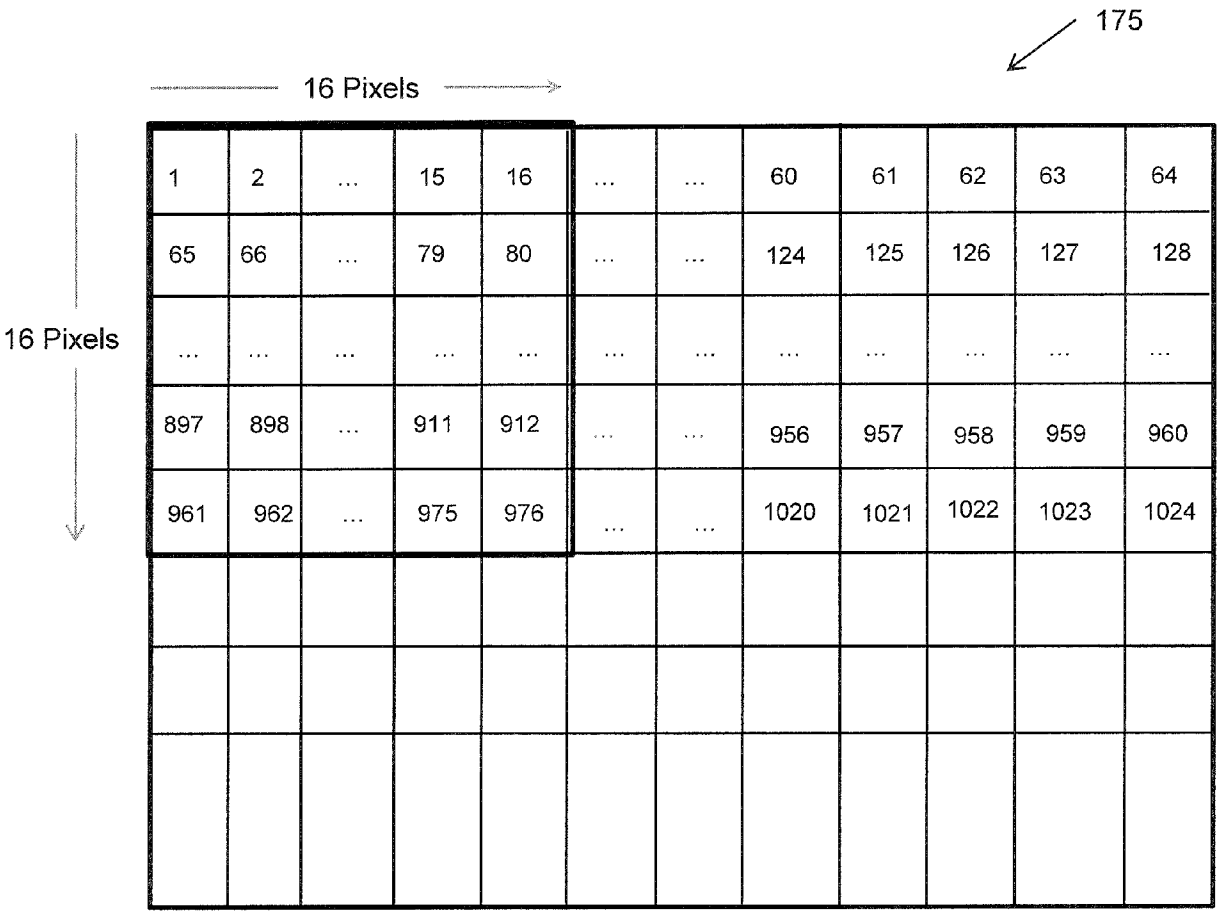
FIG. 4 illustrates one embodiment of a memory with pixels stored linearly.

With reference to FIG. 4, in another embodiment, defining and processing blocks of pixels may be applied to the organization of the frame data in memory. Generally, the frame data is stored sequentially in memory 175 corresponding to the horizontal lines of a display screen. Let each horizontal row of pixels represent being stored in one memory bank in memory 175. Each memory bank is shown with 64 pixels. Of course, other amounts can be implemented. Depending on the type of memory banks (e.g. double-data-rate (DDR) bank and row sizes), it is possible that pixel row 1 data (e.g. pixels 1-16) is in a separate memory bank than the data for pixel row 2 data (e.g. pixels 65-80). In this case, when blocks are requested, the DDR memory opens one bank to get row 1 data, and then closes the row 1 bank so that it can open another bank to get row 2 data, and so on. The opening and closing of the memory banks incurs extra latency for the data to reach the display controller 150.

Figure 5:
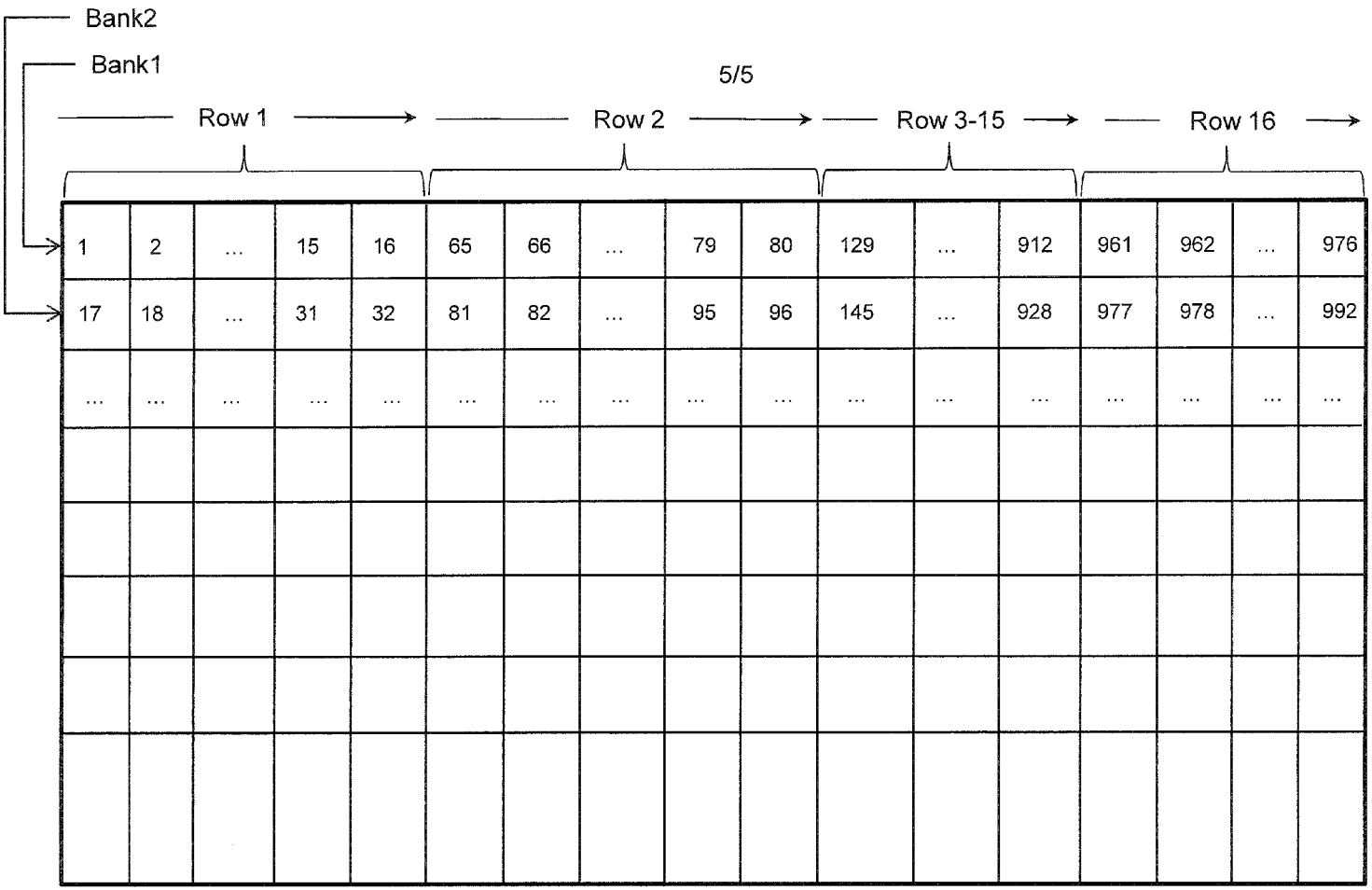
FIG. 5 illustrates one embodiment of the memory of FIG. 4 with the pixels stored in blocks.

Instead of storing the frame data linearly in memory, FIG. 5 shows the linear frame data from FIG. 4 saved sequentially according to the two-dimensional blocks as previously discussed (according to a 90 degree rotation). Each horizontal row represents one memory bank (e.g. bank 1, bank 2, etc). For example, the 16×16 block from FIG. 4, which has 16 rows, is saved in memory bank 1 with the 16 rows being sequentially stored across bank 1. Bank 2 contains the next 16×16 block of pixels from FIG. 4 and so on. When requesting data in blocks, the DDR memory then opens a bank to get row 1 data. It will not have to switch banks since row 2 data follows sequentially. Storing data as defined blocks may reduce processing time and memory accesses.

In different embodiments, logic or other components described herein may be implemented with, but not limited to, hardware, firmware stored in memory, executable instructions stored in a memory or logic device, and/or combinations thereof. In some embodiments, the display controller 150 may include a software controlled microprocessor, a discrete logic (e.g., application specific integrated circuit (ASIC), an analog circuit, a digital circuit, a programmed logic device, a memory device containing instructions, and so on. Logic may include one or more gates, combinations of gates, or other circuit components.

While example systems and methods have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the invention is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

To the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

What is claimed is:

1. A display controller implemented in at least hardware, the display controller comprising:

control logic configured to rotate a frame image by two-dimensional blocks of pixels when the frame image is rotated from an original orientation;

wherein the control logic includes rotation logic configured to rotate the frame image by:

retrieving data representing the frame image from a memory in two-dimensional block transactions wherein a two-dimensional block transaction includes retrieving pixels from multiple pixel lines in the memory where less than a full line of pixels in each of the multiple pixel lines are retrieved during each two-dimensional block transaction; and wherein the retrieving includes reading out the pixels from the memory in a rotated order based on the two-dimensional blocks, wherein each pixel is retrieved once from the memory, and displaying the pixels on a display screen in the rotated order.

2. The display controller of claim 1, where the control logic is configured to:

control refresh of the frame image in one-dimensional lines of pixels sequentially on a display screen when the frame image is not rotated; and control refresh of the frame image in the two-dimensional blocks of pixels, where the two-dimensional block of pixels spans across multiple lines on the display screen.

3. The display controller of claim 1, where the control logic comprises rotation logic for:

generating commands, in response to a request to rotate the frame image, to retrieve the data representing the frame image from the memory where the commands retrieve the data as the two-dimensional blocks of pixels; and retrieving the data from the memory in block transactions defined by the two-dimensional blocks of pixels.

4. The display controller of claim 3, where the data is retrieved from the memory in a non-rotated form, and where the rotation logic is further configured to:

store the data in a frame buffer; and generate rotated data by rotating the data in the frame buffer to a selected orientation; and where the control logic is configured to transmit the rotated data to a display screen for display.

5. The display controller of claim 1 further comprising at least one frame buffer for storing the frame image.

6. A display controller implemented in at least hardware, the display controller comprising:

control logic for rotating a frame image by two-dimensional blocks of pixels when the frame image is rotated from an original orientation; and rotation logic configured to define a size of a two-dimensional block of pixels and retrieve pixel data from the frame image by reading out pixels in a rotated manner from the defined two-dimensional blocks, where each pixel in the retrieved two-dimensional block is displayed on a display screen after being retrieved once from a memory.

7. The display controller of claim 1, wherein the control logic is configured to define the size for the two-dimensional blocks based on a communication protocol used between the control logic and the memory.

8. The display controller of claim 1, where the control logic is configured to store the frame image in memory as the two-dimensional blocks.

9. The display controller of claim 1, wherein the hardware includes at least a non-transitory storage medium with instructions stored thereon configured to implement the control logic.

10. A method, comprising:

retrieving, by a display controller, data representing an image from a memory as two-dimensional blocks of pixel data;

wherein the data is retrieved from the memory in two-dimensional block transactions where a two-dimensional block transaction includes reading out pixel data from multiple pixel lines in the memory from the two-dimensional blocks in a rotated order, where less than a full line of pixels in each of the multiple pixel lines are retrieved during each two-dimensional block transaction, and wherein each pixel is retrieved once from the memory; and causing the pixel data read in the rotated order from the two-dimensional blocks to be displayed on a display screen as a rotated image.

11. The method of claim 10, wherein the data is retrieved from the memory in a first order of pixels and stored in a buffer; and wherein the rotating includes reading the data from the buffer in two-dimensional block transactions in a second order of pixels that causes the data to be rotated.

12. The method of claim 10, where prior to retrieving the data:

generating commands to retrieve the data in response to a request to rotate an image on the display screen, wherein the commands include information that define a size of a two-dimensional block to be retrieved.

13. The method of claim 12, where generating the commands includes generating instructions that indicate a starting address from which to read data from the memory, a number of pixels to read per line, and a number of lines, where the number of pixels to read per line and the number of lines defines a block size.

14. The method of claim 10, where for each retrieved block of pixel data, each pixel within the retrieved block is displayed on the display screen without re-fetching pixels from the retrieved block.

15. The method of claim 10, further comprising:

controlling the display screen to refresh a frame image in one-dimensional lines of pixels sequentially on the display screen when the frame image is not rotated; and controlling the display screen to refresh the frame image as blocks of pixels corresponding to the two-dimensional blocks of pixel data when the frame image is rotated.

16. The method of claim 10, further comprising storing the frame image in memory as two-dimensional blocks of pixel data where each block is stored in a single memory bank.

17. A display controller implemented in at least hardware, the display controller comprising:

control logic configured to retrieve a frame image from a memory in two-dimensional blocks, wherein the frame image is retrieved in two-dimensional block transactions where a two-dimensional block transaction includes retrieving pixels from multiple pixel lines in the memory where less than a full line of pixels in each of the multiple pixel lines are retrieved during each two-dimensional block transaction, and wherein each pixel is retrieved once from the memory for a rotation operation;

rotation logic configured to rotate the frame image by rotating the two-dimensional blocks of the retrieved frame image in accordance with a rotation angle by reading out the pixels from the two-dimensional blocks in a rotated order based on the rotation angle; and where the display controller is configured to control a display device to display the rotated frame image by displaying the pixels read out from the rotated two-dimensional blocks sequentially on a display screen.

18. The display controller of claim 17, where the control logic is configured to switch between causing the rotated frame image to be refreshed in accordance with the two-dimensional blocks in response to a rotation request and causing the display device to refresh the frame image in one-dimensional lines when the frame image is not rotated.

19. The display controller of claim 17 where the control logic is configured to store pixels from the frame image in a memory in accordance with the two-dimensional blocks, where pixels from one two-dimensional block are stored in a same memory bank.

20. The display controller of claim 17 where the control logic is configured to store the frame image in memory as two-dimensional blocks of pixel data where each block is stored in a single memory bank.

* * * * *